US009932831B2

(12) United States Patent
Twelves, Jr. et al.

(10) Patent No.: US 9,932,831 B2
(45) Date of Patent: Apr. 3, 2018

(54) HIGH TEMPERATURE COMPLIANT METALLIC ELEMENTS FOR LOW CONTACT STRESS CERAMIC SUPPORT

(71) Applicant: United Technologies Corporation, Hartford, CT (US)

(72) Inventors: Wendell V Twelves, Jr., Glastonbury, CT (US); Kathleen E. Sinnamon, Manchester, CT (US); Lyutsia Dautova, Rocky Hill, CT (US); Evan Butcher, Manchester, CT (US); Joe Ott, Enfield, CT (US); Matthew E. Lynch, Canton, CT (US)

(73) Assignee: United Technologies Corporation, Farmington, CT (US)

( * ) Notice: Subject to any disclaimer, the term of this patent is extended or adjusted under 35 U.S.C. 154(b) by 173 days.

(21) Appl. No.: 14/695,466

(22) Filed: Apr. 24, 2015

(65) Prior Publication Data

US 2015/0322806 A1 Nov. 12, 2015

Related U.S. Application Data

(60) Provisional application No. 61/991,185, filed on May 9, 2014.

(51) Int. Cl.

| | |
|---|---|
| ***F01D 5/30*** | (2006.01) |
| ***F01D 5/02*** | (2006.01) |
| *F23R 3/00* | (2006.01) |

(52) U.S. Cl.

CPC ..... *F01D 5/025* (2013.01); *F01D 5/30* (2013.01); *F01D 5/3084* (2013.01); *F05D 2260/38* (2013.01); *F05D 2300/501* (2013.01); *F05D 2300/50212* (2013.01); *F05D 2300/6033* (2013.01); *F23R 3/007* (2013.01); *Y10T 403/217* (2015.01)

(58) Field of Classification Search

None

See application file for complete search history.

(56) References Cited

U.S. PATENT DOCUMENTS 2,559,048 A * 7/1951 Seaman ..... A01B 33/144 172/543

3,259,383 A 6/1964 Johnson et al.

(Continued)

FOREIGN PATENT DOCUMENTS

DE 2850941 A1 6/1980

EP 2613021 A2 4/2013

(Continued)

OTHER PUBLICATIONS

European Search Report dated Oct. 2, 2015, for corresponding European Patent Application No. 15167214.4.

*Primary Examiner* — Joshua J Michener

*Assistant Examiner* — Kyle J. Walraed-Sullivan

(74) *Attorney, Agent, or Firm* — Kinney & Lange, P.A.

(57) ABSTRACT

A ceramic component retention system includes a metallic component, a ceramic component, and at least one spring element arranged between the metallic component and the ceramic component. The metallic component has a first coefficient of thermal expansion, and the ceramic component has a second coefficient of thermal expansion. The at least one spring element is configured to mechanically couple the ceramic component to the metallic component.

7 Claims, 13 Drawing Sheets

(56) References Cited

U.S. PATENT DOCUMENTS 3,784,320 A 1/1974 Rossmann et al.
3,960,209 A * 6/1976 Neubrand ..... F28D 19/048 165/8
4,030,875 A * 6/1977 Grondahl ..... F23C 3/00 60/753
4,058,157 A * 11/1977 Wiegard ..... F28D 19/048 165/8
4,325,647 A 4/1982 Maier et al.
4,328,856 A * 5/1982 Cunningham ..... F28D 19/00 165/8
4,655,687 A 4/1987 Atkinson
5,183,270 A * 2/1993 Alten ..... F16J 15/3452 277/397
5,279,211 A 1/1994 Bentz et al.
5,299,939 A * 4/1994 Walker ..... H01R 13/33 439/284
5,571,327 A * 11/1996 Ookouchi ..... C23C 2/003 118/423
6,230,609 B1 * 5/2001 Bender ..... F04B 43/0054 92/103 R
7,555,906 B2 * 7/2009 Anichini ..... F23M 5/04 60/798
7,762,076 B2 7/2010 Shi et al.
7,874,059 B2 1/2011 Morrison et al.
8,167,546 B2 5/2012 Shi et al.
2001/0032453 A1 * 10/2001 Tatsumi ..... F23R 3/60 60/796
2003/0202876 A1 * 10/2003 Jasklowski ..... F01D 11/025 415/135
2004/0036230 A1 * 2/2004 Matsuda ..... F01D 9/023 277/632
2004/0164051 A1 * 8/2004 Stoving ..... H01H 33/6645 218/118
2004/0164052 A1 * 8/2004 Stoving ..... H01H 33/66207 218/118
2005/0206097 A1 * 9/2005 Datta ..... F16J 15/3212 277/644
2005/0265830 A1 * 12/2005 Tatsumi ..... F01D 9/042 415/191
2008/0106046 A1 * 5/2008 Datta ..... F16J 15/0887 277/644
2009/0056924 A1 * 3/2009 Inatomi ..... F28F 7/02 165/165
2009/0260364 A1 * 10/2009 Keller ..... F01D 9/023 60/753
2010/0263194 A1 * 10/2010 Morrison ..... F16B 5/0266 29/525.04
2010/0307162 A1 * 12/2010 Bottcher ..... F23M 5/04 60/752
2012/0051923 A1 3/2012 McDonald et al.
2013/0251446 A1 * 9/2013 Bird ..... F16B 5/0635 403/220
2014/0003880 A1 * 1/2014 Grooms, II ..... F16B 35/00 411/378
2014/0308113 A1 * 10/2014 Westphal ..... F01D 11/00 415/134
2014/0328677 A1 * 11/2014 Klausen ..... F16C 35/02 415/229

FOREIGN PATENT DOCUMENTS

EP 2642076 A2 9/2013
FR 1163439 A 9/1958
GB 753229 A 7/1956
GB 2062119 A 7/1980
WO 2014/035613 A2 3/2014

* cited by examiner

HIGH TEMPERATURE COMPLIANT METALLIC ELEMENTS FOR LOW CONTACT STRESS CERAMIC SUPPORT

CROSS-REFERENCE TO RELATED APPLICATION(S)

This application claims the benefit of U.S. Provisional Application No. 61/991,185 filed May 9, 2014 for "High Temperature Compliant Metallic Elements for Low Contact Stress Ceramic Support" by W. Twelves, Jr., K. Sinnamon, L. Dautova, E. Butcher, J. Ott, and M. Lynch.

BACKGROUND

Ceramic and metallic components each have characteristics that are beneficial in some aerospace applications and detrimental in others. For example, ceramic components tend to exhibit sensitivity to localized contact stress, have low tolerance for strain or tension, and exhibit brittle behavior. However, ceramics have good compression properties and good tolerance to high temperatures. Metallic components typically have higher tolerance for local contact stress, handle elastic and plastic strain well, and better tension properties compared to ceramics, but have lower tolerance for high temperatures as compared to ceramics. Ceramics generally have lower coefficients of thermal expansion than metals.

It is often beneficial to utilize ceramic components in some areas of the engine while using metallic components in other areas. The metallic and ceramic components must be mechanically coupled to one another in many cases. Due to the differences in the coefficients of thermal expansion, ceramic and metallic components that experience large temperature ranges in operation cannot be directly connected.

SUMMARY

A ceramic component retention system includes a metallic component, a ceramic component, and at least one spring element. The metallic component has a first coefficient of thermal expansion, and the ceramic component has a second coefficient of thermal expansion. The at least one spring element is arranged between the metallic component and the ceramic component, and is configured to mechanically couple the ceramic component to the metallic component.

DETAILED DESCRIPTION

Several compliant, metal spring-like elements are arranged between a ceramic component, such as a ceramic matrix composite (CMC) component, and a metallic component. Because each element is compressible between the CMC component and the metallic component, differences in coefficients of thermal expansion (CTE) are accommodated. These compliant, metal springs enable CMC parts to be mechanically attached to metallic structures without risk of damage from excessively high localized contact stress from static loads, dynamic loads, differential growth due to CTE differences, or a change in shape of the faying surfaces from transient or sustained thermal distortion.

Figure 1:
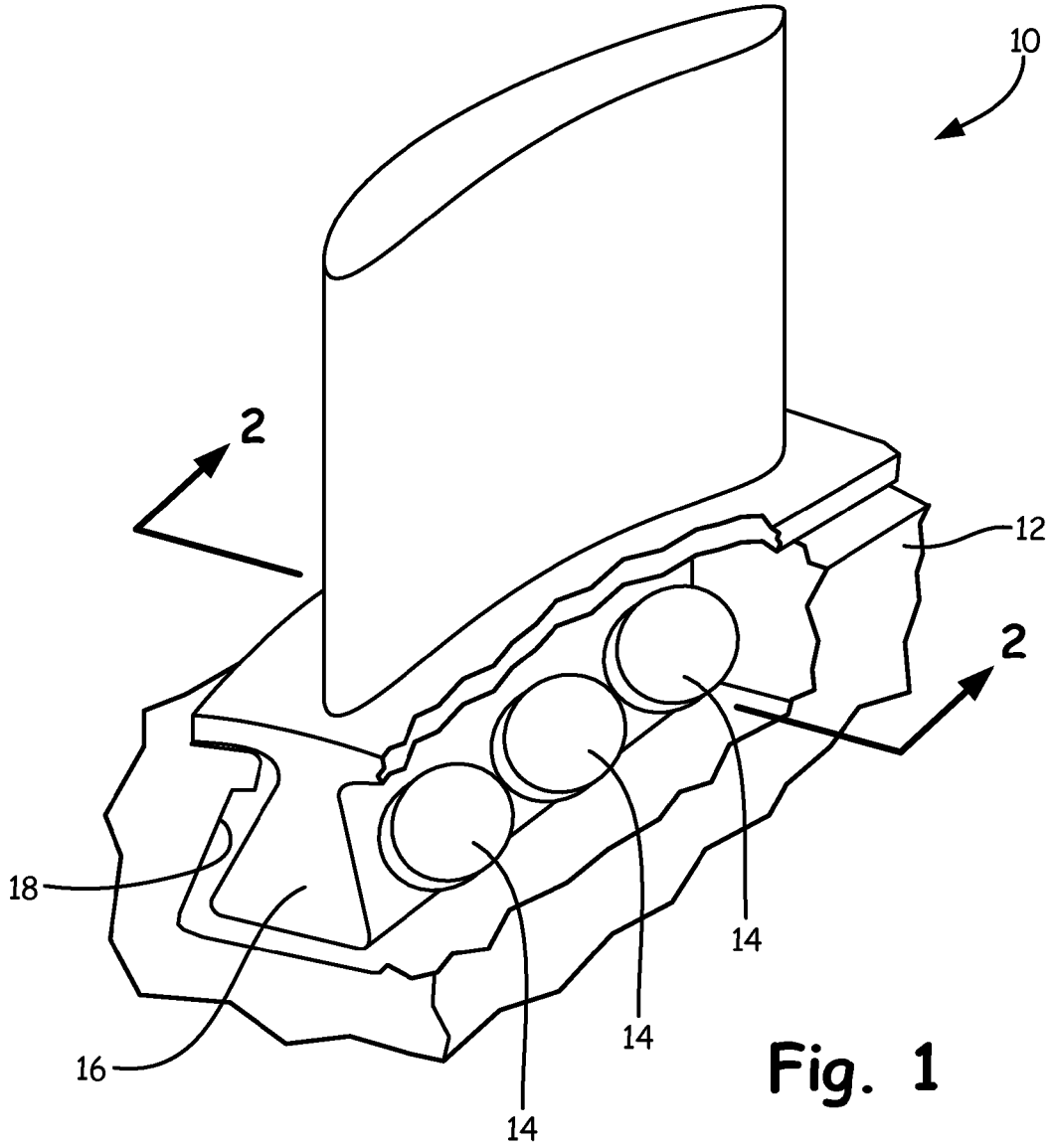
FIG. 1 is a cutaway perspective view of a ceramic matrix composite blade held in a disk by several springs.
Figure 2:
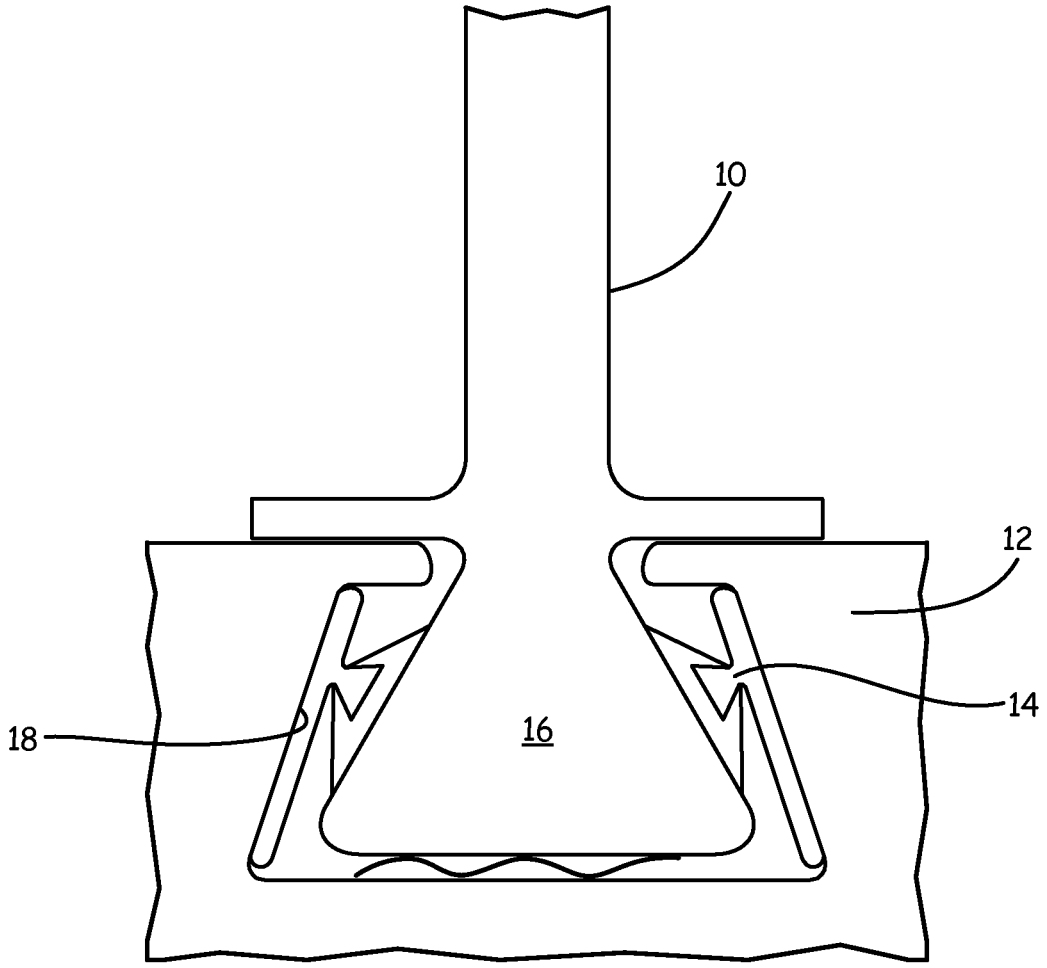
FIG. 2 is a cross-sectional view of the ceramic matrix composite blade as seen from line 2-2 of FIG. 1.

FIG. 1 is a cutaway perspective view of CMC blade 10 held by metallic disk 12, which together form a ceramic/metal assembly. FIG. 2 is a cross-sectional view of CMC blade 10 as seen from line 2-2 of FIG. 1. As shown in FIGS. 1-2, compliant, elastically deformable spring elements 14 are interposed between CMC blade 10 and metallic disk 12. In particular, compliant spring elements 14 are arranged between root 16 of CMC blade 10 and faying surface 18 of metallic disk 12.

CMC blade 10 is an airfoil, for example a turbine blade of a gas turbine engine. Turbine sections often route airstreams that are extremely hot. For example, gas turbine engines used in aerospace applications often generate airstreams having temperatures of 1000° C. or greater. CMC blade 10 can be used to extract energy from such a hot airstream, where a metallic component would not be suitable due to the temperature restrictions of metallic materials.

Metallic disk 12 is a rotatable disk that holds CMC blade 10. In most cases, metallic disk 12 holds multiple CMC blades 10. Metallic disk 12 may experience significant tensile stress at high rates of rotation. When used in the turbine section of a gas turbine engine, as discussed above with respect to CMC blade 10, metallic disk 12 may be heated by a hot airstream. However, unlike CMC blade 10, metallic disk 12 is not subject to as much direct impingement by the hot airstream as CMC blade 10. Thus, metallic disk 12 may be comprised of metallic materials, such as high-temperature superalloys, that would not be suitable for CMC blade 10.

In accordance with the present disclosure, elastically deformable compliant spring elements 14 couple root 16 of CMC blade 10 to faying surface 18 of metallic disk 12 (FIG. 2). Root 16 is a portion of CMC blade 10 that extends into metallic disk 12 such that force exerted on CMC blade 10 may be translated into rotational momentum for metallic disk 12. Faying surface 18 is a surface of metallic disk 12 that is cast or cut out to a complementary shape for the geometry of root 16.

Compliant spring elements 14 are interposed between CMC blade 10 and metallic disk 12. CMC blade 10 and metallic disk 12 often have different CTEs. Often, CMC blade 10 has a much lower CTE than metallic disk 12. Thus, heating of CMC blade 10 and metallic disk 12 can cause metallic disk 12 to hold CMC blade 10 more loosely, whereas cooling can cause metallic disk 12 to hold CMC blade 10 more tightly. When CMC blade 10 is held loosely by metallic disk 12, compliant spring elements 14 provide force to retain CMC blade 10. In either case, compliant spring elements 14 reduce or eliminate localized stresses on CMC blade 10 when CMC blade 10 is held tightly, and compliant spring elements 14 supply force to retain CMC blade 10 in metallic disk 12 when CMC blade 10 is held loosely. Compliant spring elements 14 effectively distribute contact loads and protect the brittle ceramic material from localized stress concentrations.

Compliant spring elements 14 permit the use of ceramic elements where the properties of ceramics (e.g., thermal tolerance) are beneficial, and the use of metallic elements where the properties of metals (e.g., tensile strength) are beneficial. It will be appreciated that because compliant spring elements 14 (further discussed below) are positioned between CMC blade 10 and metallic disk 12, the operative association between (e.g., the interface of ceramic and metallic materials of) blade 10 and disk 12 is not subject to failure modes related to different coefficients of thermal expansion.

Figure 3:
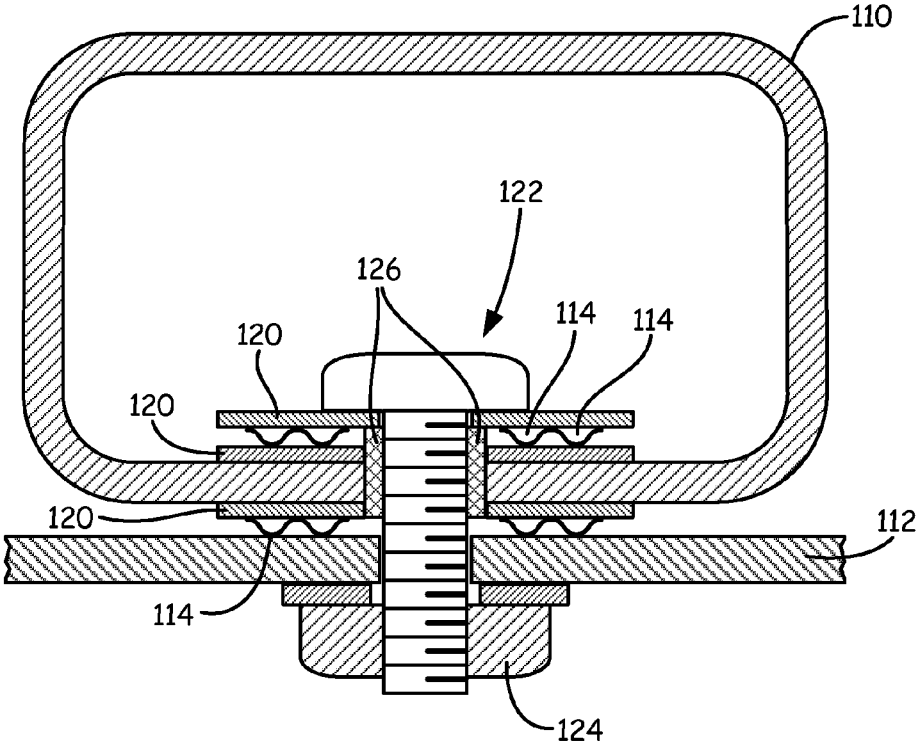
FIG. 3 is a perspective view of a ceramic tile engagement mechanism.

FIG. 3 is a perspective view of CMC tube 110 mechanically coupled to metallic structure 112 by compliant spring elements 114. The structure shown in FIG. 3 utilizes compliant spring elements 114 in a similar way to compliant spring elements 14 of FIGS. 1-2; to reduce or eliminate stresses (e.g., point stresses) on CMC tube 110 related to unequal coefficients of thermal expansion. CMC tube 110 may be used, for example, as a thermal shield in a duct of a gas turbine engine.

In addition to CMC tube 110, metallic structure 112, and compliant spring elements 114, FIG. 3 illustrates washers 120, bolt 122, nut 124, and felt metal gasket 126.

Washers 120 are positioned between bolt 122 and compliant spring elements 114, and between nut 124 and compliant spring elements 114. Bolt 122 is threadably engaged with nut 124 to apply compressive force to mechanically bind CMC tube 110 to metallic structure 112. Washers 120 distribute this load across several compliant spring elements 114, which decreases point loads on CMC tube 110.

Felt metal gasket 126 is also useful for preventing damage to CMC tile 110. Felt metal gasket 126 is made of felt metal, and positioned between bolt 122 and CMC tube 110. Felt metal is made of short metal fibers sintered together. Felt metal gasket 126 may be used to distribute point contact stresses that bolt 122 could put on CMC tube 110, such as mechanical contact with the shank or threads present on bolt 122.

The system shown in FIG. 3 shows how compliant spring elements 114 may be used in systems other than bladed disks (as described with respect to FIGS. 1-2). For example, CMC tube 110 may be used as a thermal shield in a variety of places throughout a gas turbine engine. In such a setting, CMC tube 110 prevents direct thermal contact between a hot gas and metal substrate 112. Although CMC tube 110, metal substrate 112, and bolt 122 may have different coefficients of thermal expansion, point stresses on CMC tube 110 are mitigated by the elastic deformation of compliant spring elements 114.

Figure 4:
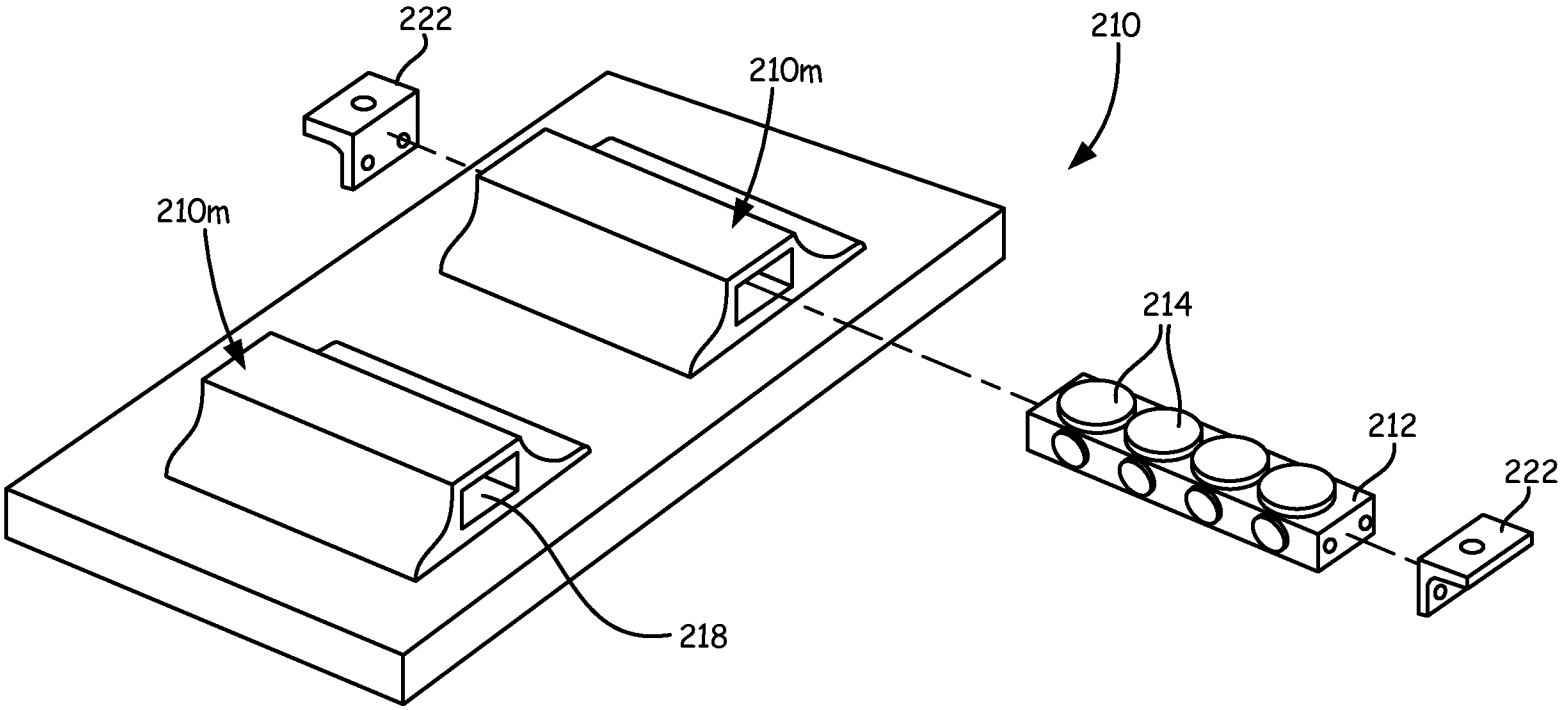
FIG. 4 is an exploded perspective view of an alternative ceramic tile engagement mechanism.

FIG. 4 is an exploded perspective view of an engagement system for CMC tile 210. FIG. 4 shows CMC tile 210, metal beam 212, compliant spring elements 214, and end fittings 222. CMC tile 210 includes mounting slots 210*m*. Mounting slots 210*m* define faying surface 218.

The structure shown in FIG. 4 utilizes compliant spring elements 214 in a similar way to compliant spring elements (14, 114) of the previous figures, to reduce or eliminate point stresses on CMC tile 210 related to unequal coefficients of thermal expansion. CMC tile 210 may be used, for example, as a thermal shield in a duct of a gas turbine engine. Metal beam 212 is a structural support to which CMC tile 210 can be mounted.

Mounting slots 210*m* extend from CMC tile 210 to define faying surfaces 218. Compliant spring elements 214 are arranged along faying surface 218 (i.e., between mounting slots 201*m* and metal beam 212). Compliant spring elements 214 may be mounted on all four sides of metal beam 212. End fittings 222 are configured to attach to metal beam 212. However, end fittings 222 are too large to fit through the aperture defined by faying surface 218, and thus end fittings 222 keep CMC tile 210 mechanically engaged to metal beam 212.

In operation, hot gases pass along some portion of CMC tile 210. Metal beam 212 is protected from direct contact with the hot gases by CMC tile 210. As CMC tile 210, metal beam 212, compliant spring elements 214, and/or end fittings 222 change in temperature, each component changes in size by an amount corresponding to its CTE.

Because compliant spring elements 214 are compressible and expandable within mounting slots 210*m*, point stresses on CMC tile 210 that could be caused by thermal expansion or contraction are mitigated.

Figure 5:
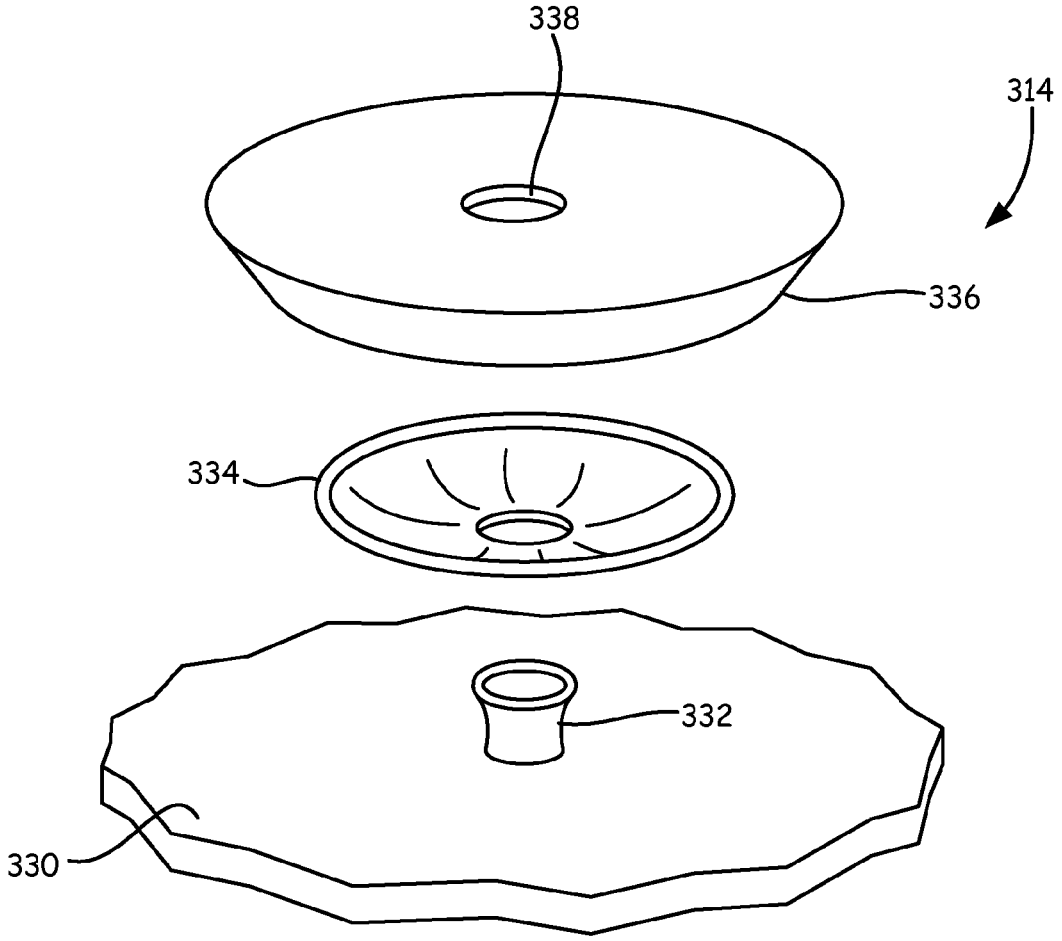
FIG. 5 is an exploded perspective view of a conical spring.

FIG. 5 is an exploded perspective view of compliant spring element 314. Compliant spring element 314 includes metallic substrate 330, retention feature 332, cone spring 334, and contact pad 336. Contact pad 336 defines powder removal hole 338.

Compliant spring element 314 is a deformable element that may be positioned between two components. Compliant spring element 314 can exhibit spring-like behavior through a specified range of displacement (e.g., 254-1270 μm (0.010-0.050 in.)). Depending on the application, the compliant features of compliant spring element 314 (as well as others of the spring element embodiments described herein) may be either elastically or plastically deformable. Compliant spring element 314 provides a compliant, high temperature surface with multiple, low stress contact regions designed to provide a cushioned load distributing support surface.

In one embodiment, compliant spring element 14 of FIGS. 1-2 may be a compliant spring element 314. Likewise, compliant spring element 114 of FIG. 3, as well as compliant spring element 214 of FIG. 4, may be a compliant spring element 314.

Metallic substrate 330 is made of a metal, and affixed to retention feature 332. Metallic substrate 330 can either be separate or integral with a metallic component (e.g., metallic substrates 12, 112, and 212 of FIGS. 1-2, 3, and 4, respectively) that is attached to a CMC component (e.g., CMC components 10, 110, 210 of FIGS. 1-2, 3, and 4, respectively).

Retention feature 332 extends from metallic substrate 330 to anchor cone spring 334. Cone spring 334 is elastically deformable against metallic substrate 330. In some embodiments, a Belleville washer may be used as cone spring 334.

Contact pad 336 is attached to cone spring 334. In some embodiments, contact pad 336 may snap on to cone spring 334. In other embodiments, contact pad 336 and cone spring 334 may be additively manufactured such that cone spring 334 is permanently captured by contact pad 336. Contact pad 336 is configured to be arranged adjacent to a CMC component, as previously mentioned. In order to minimize stresses on that adjacent component, contact pad 336 may be made of a CMC material, or another material with a coefficient of thermal expansion similar to that of the adjacent component. Differences between the coefficients of thermal expansion of cone spring 334 and contact pad 336 do not adversely affect compliant spring element 314, as cone spring 334 is free to slide along contact pad 336.

In operation, compliant spring element 314 is subject to temperature fluctuations, as well as varying levels of compression. As compliant spring element 314 heats, metallic substrate 330, retention feature 332, and cone spring 334 may expand more rapidly than contact pad 336. Because cone spring 334 can slide along contact pad 336, point stresses on contact pad 336 are reduced or eliminated. Compression of contact pad 336 towards metallic substrate 330 results in a flattening of cone spring 334. Under such compression, cone spring 334 splays outwards along contact pad 336 as (on the underside in the orientation shown in FIG. 5). Retention feature 332 limits or prevents displacement of contact pad 336 and cone spring 334 in any other direction.

Compliant spring element 314 may be additively manufactured. In the embodiment shown, powder removal hole 338 allows for unsintered powder from additive manufacturing to be extracted after additive manufacturing is complete. In alternative embodiments of compliant spring element 314, powder removal hole 338 is not necessary, for example where additive manufacturing is not used to create compliant spring element 314.

Figure 6:
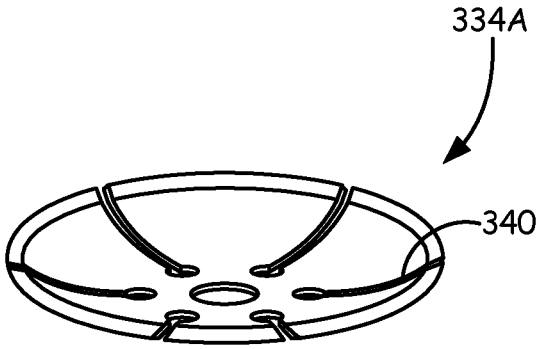
FIG. 6 is a perspective view of a conical spring element having a slotted wall.

FIG. 6 is a perspective view of cone spring 334A having a plurality of slots 340. Slots 340 reduce the spring constant of cone spring 334A, as compared to an otherwise equivalent conical spring element.

Figure 7:
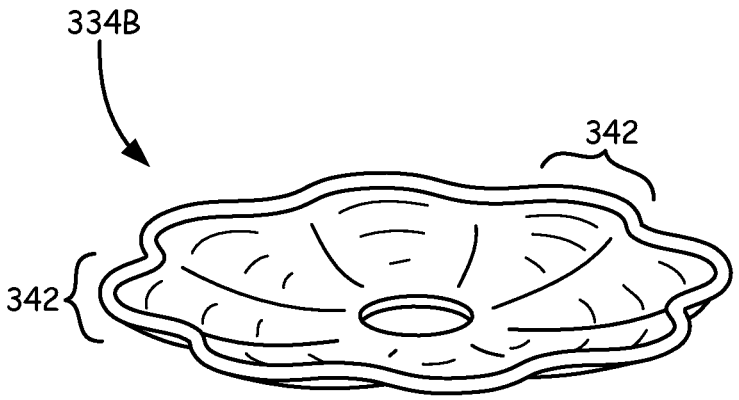
FIG. 7 is a perspective view of a conical spring element having a scalloped wall.

FIG. 7 is a perspective view of cone spring 334B having a scalloped geometry. Cone spring 334B includes scallops 342, which reduce the spring constant of cone spring 334B, as compared to an otherwise equivalent conical spring element.

Figure 8:
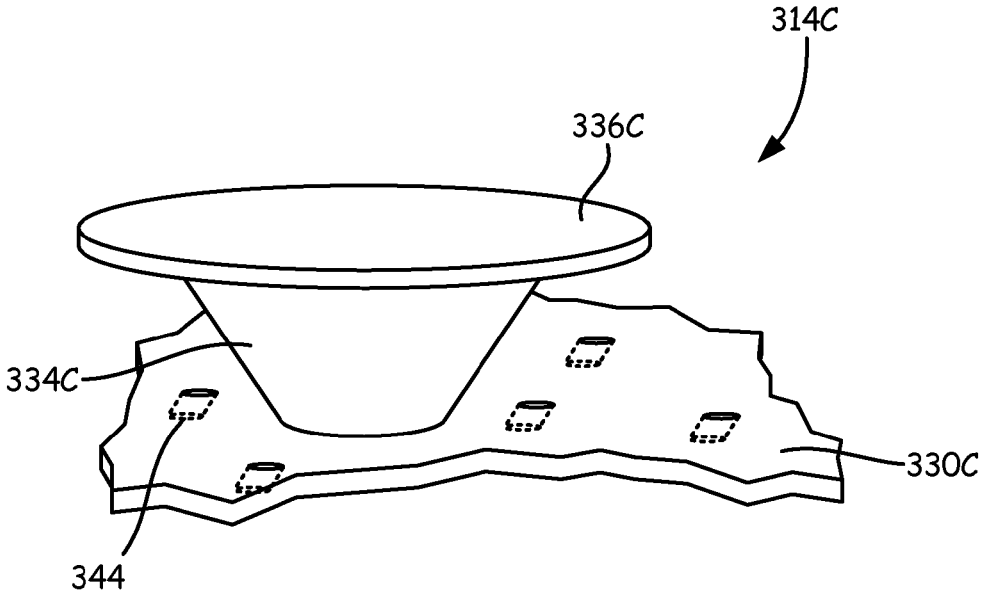
FIG. 8 is a perspective view of a conical spring element having cooling features.

FIG. 8 is a perspective view of compliant spring element 314C including conical spring 334C. Conical spring 334C is mounted to metallic substrate 330C, which includes cooling features 344, shown extending through metallic substrate 330C in phantom. As described previously with respect to contact pad 336 and cone spring 334 of FIG. 5, contact pad 336C of FIG. 8 is mechanically connected to conical spring 334C.

In some embodiments, compliant spring element 314C may be arranged between a ceramic component and a cooling air duct (not shown). In such embodiments, cooling air may be routed through metallic substrate 330C via cooling features 344 and impinge upon conical spring 334C. This cooling air impingement can prevent overheating of conical spring 334C that could lead to, for example, flowing or melting of conical spring 334C. In alternative embodiments, metallic substrate 330C may be a cooling duct, and need not be made of a metal.

Figure 9:
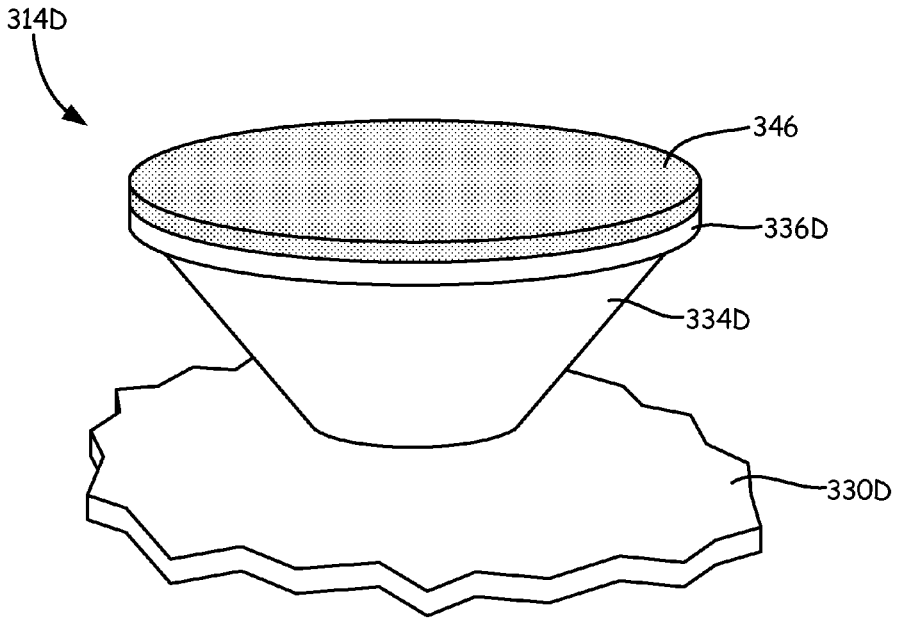
FIG. 9 is a cross-sectional view of a conical spring element having a compliant gasket.

FIG. 9 is a cross-sectional view of conical spring element 314D. Conical spring element 314D includes metallic substrate 330D, conical spring 334D, contact pad 336D, and compliance gasket 346. Metallic substrate 330D, conical spring 334D, and contact pad 336D are substantially the same as those described with respect to the preceding figures. Compliance gasket 346 is a layer of material arranged along contact pad 336D. Compliance gasket 346 may be, for example, felt metal, or a ceramic fiber gasket. In low temperature applications, compliance gasket 346 can be an elastomeric material. Compliance gasket 346 improves distribution of contact loads incident on contact pad 336D by conforming to surface irregularities on contact pad 336D and any adjacent surface.

Figure 10B:
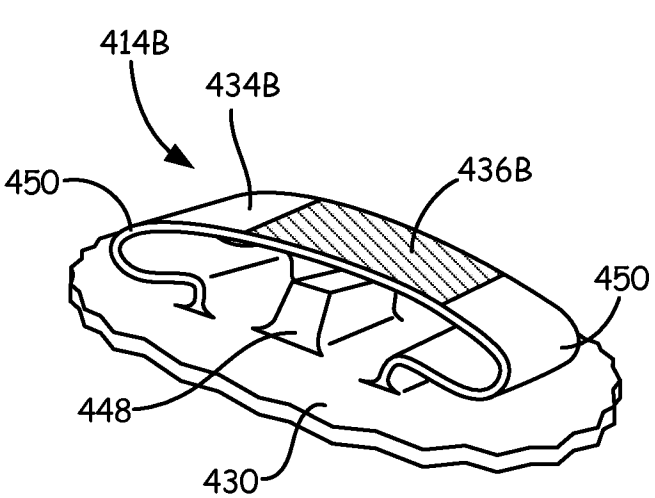
FIGS. 10A and 10B are cutaway perspective views of arch springs.
Figure 10A:
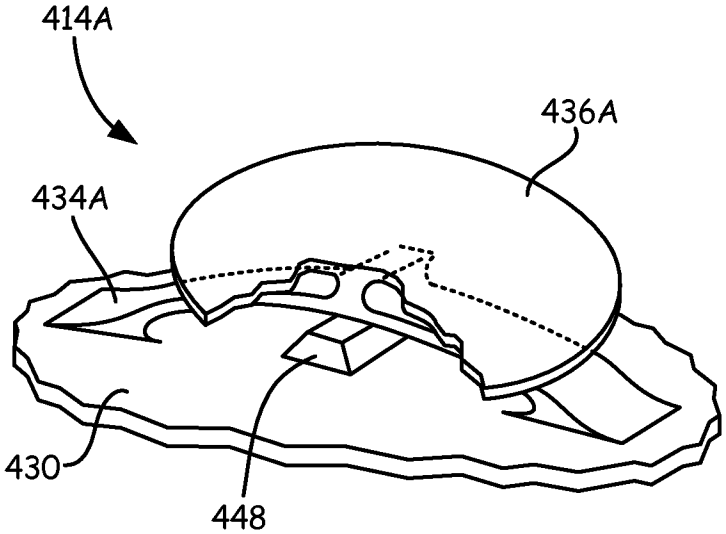

FIGS. 10A and 10B are cutaway perspective views of compliant spring elements 414A and 414B, respectively. Compliant spring element 414A of FIG. 10A includes metallic substrate 430, arch spring 434, contact pad 436A, and deflection limiter 448.

Metallic substrate 430 is substantially similar to the other metallic substrates previously described with respect to other figures. For example, metallic substrate 430 could be a metallic disk for holding a CMC blade, or a beam for mounting a CMC tile, or a metal duct.

Arch spring 434 is a metallic component that deforms when a compressive load is applied to contact pad 436A. In the embodiment shown in FIG. 10A, arch spring 434 is an elastically deformable spring. Deflection limiter 448 is positioned between arch spring 434 and metallic substrate 430 to prevent deflection of arch spring 434 beyond a certain point, for example the point at which arch spring 434 is likely to inelastically deform.

FIG. 10B shows compliant spring element 414B, which is substantially similar to compliant spring element 414A but for two structural differences. First, compliant spring element 414B includes contact region 436B in place of contact pad 436A of FIG. 10A. For some applications, contact region 436B sufficiently spreads compressive force to an adjacent component (not shown). Second, compliant spring element 414B includes an alternate arch spring 434B, in that arch spring 434B includes distensions 450. Alternate arch spring 434B is shaped to change the deformation mode of compliant spring element 414B and provide for a relatively lower spring rate as compared to spring element 414A of FIG. 10A.

Figure 11:
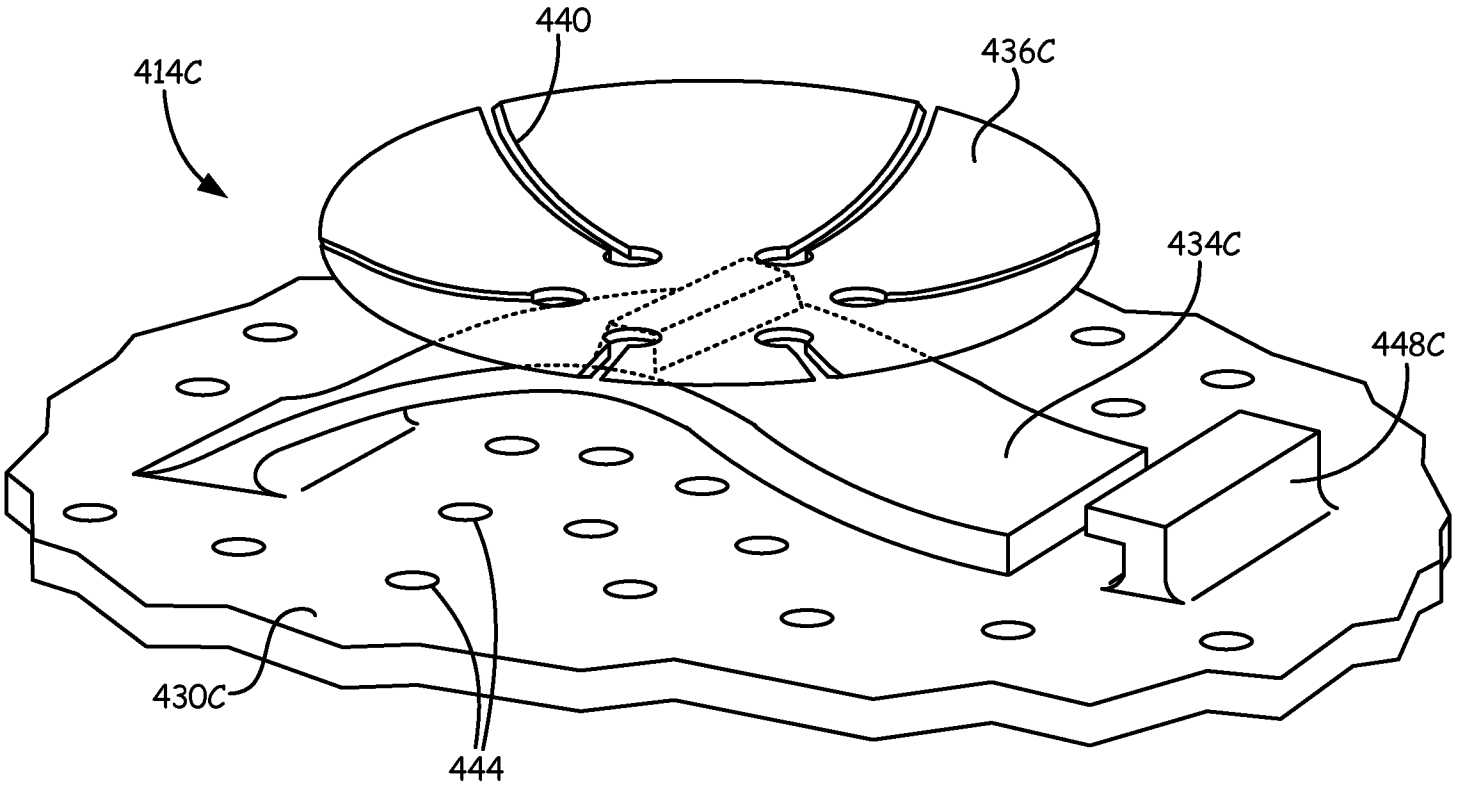
FIG. 11 is a perspective view of an arch spring element having cooling features.

FIG. 11 is a perspective view of a compliant spring element 414C, which includes various cooling features and an alternative deflection limiting system. In particular, compliant spring element 414C includes metallic substrate 430C, including cooling features 444. Cooling air may be routed through metallic substrate 430C via cooling features 444 and impinge upon arch spring 434C. This cooling air impingement can prevent overheating of arch spring 434C that could lead to, for example, flowing or melting of arch spring 434C, as previously described with respect to conical spring 334C of FIG. 8. In some embodiments, metallic substrate 430C may be a cooling duct, and need not be made of a metal.

Additionally, the embodiment shown in FIG. 11 illustrates slots 440. Slots 440 reduce the spring constant of conical spring element 434C, as compared to an otherwise equivalent spring element, as previously described with respect to FIG. 6.

Finally, alternative deflection limiter 448C prevents deformation of arch spring 434C beyond a desired limit. In the embodiment shown in FIG. 11, arch spring 434C is affixed to metallic substrate 430C at one end, and the other end is free to slide along metallic substrate 430C. As arch spring 434C is deformed by compressive force applied to contact pad 436C, arch spring 434C slides along metallic substrate 430C until it comes into contact with alternate deflection limiter 448C.

Figure 12:
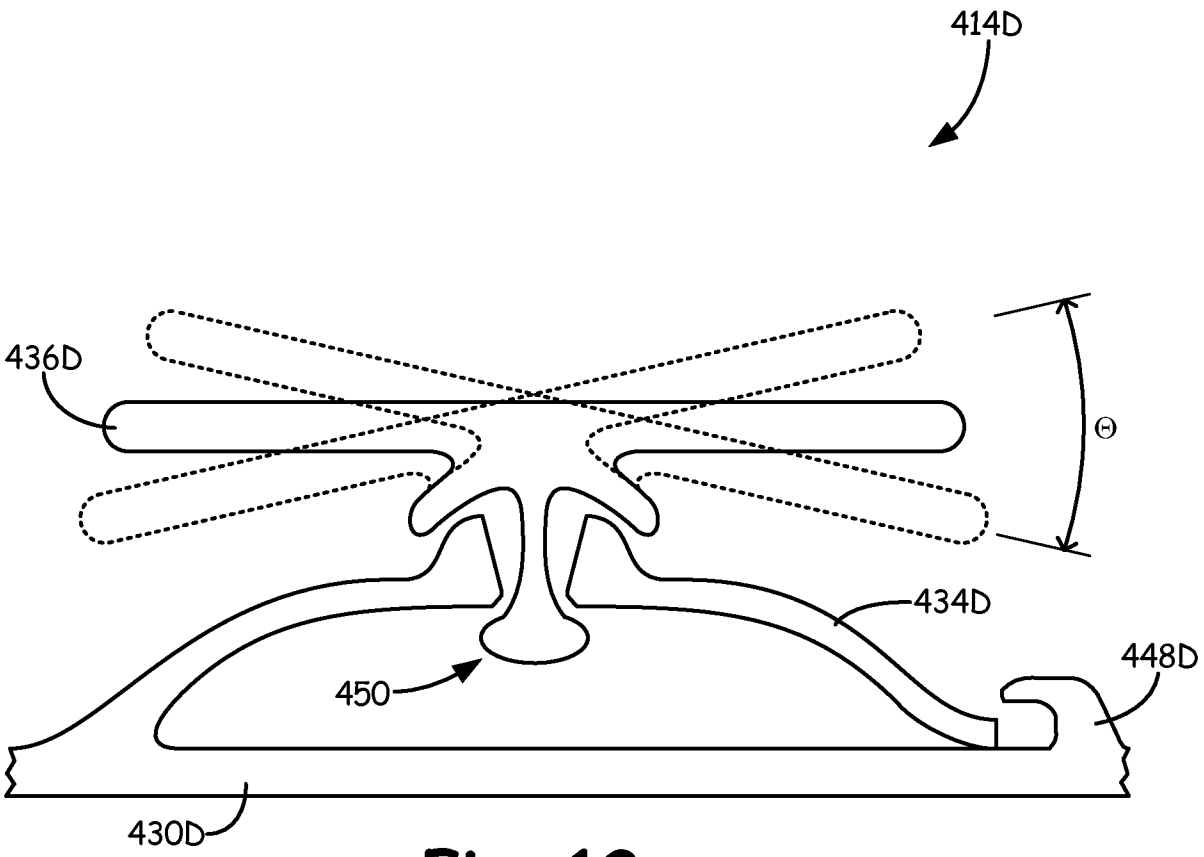
FIG. 12 is a cross-sectional view of an arch spring element having a compliant angle.

FIG. 12 is a cross-sectional view of compliant spring element 414D, which includes arch spring element 434D. Compliant spring element 414D includes metallic substrate 430D, arch spring 434D, contact pad 436D, deflection limiter 448D, and ball joint 450. Arch spring 434D contacts metallic substrate 430D at one free end, translatable along metallic substrate 430D until it contacts deflection limiter 448D.

Ball joint 450 is located at the junction of contact pad 436D with arch spring 434D. Ball joint 450 permits movement of contact pad 436D within a compliance angle θ. In some systems, thermal expansion or contraction of components separated by compliant spring element 414D may result in angular movement of those components. Compliance angle θ allows for such angular movement while maintaining desired compression and minimizing or eliminating potentially damaging point loads.

Figure 13:
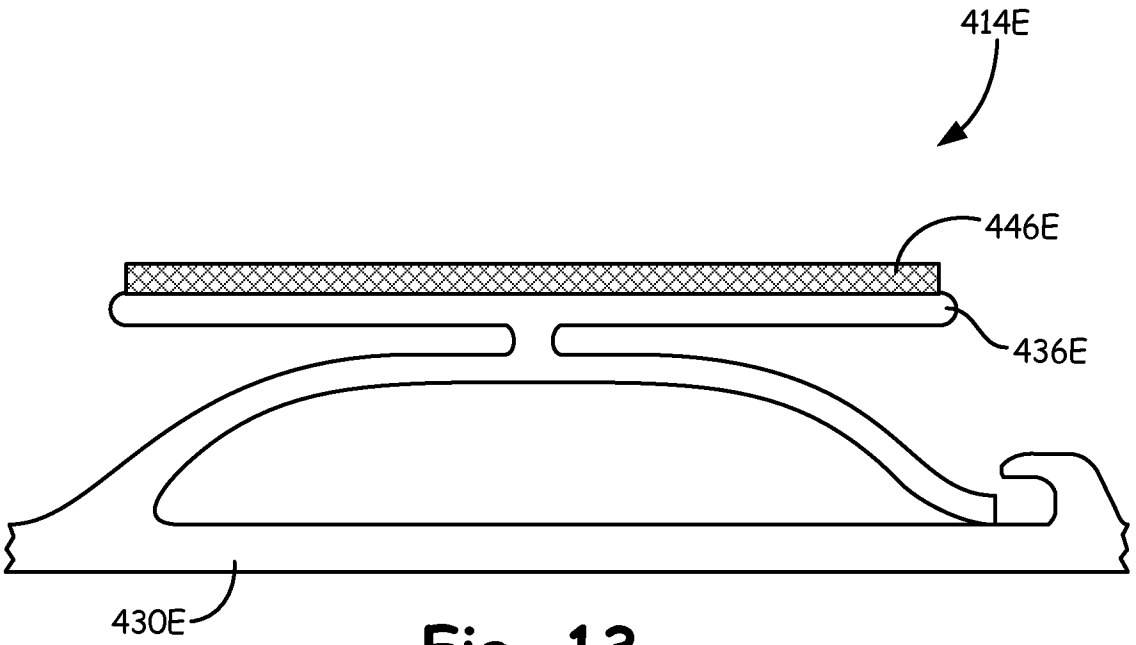
FIG. 13 is a cross-sectional view of an arch spring element having a compliance gasket.

FIG. 13 is a cross-sectional view of compliant spring element 414E having gasket 446. Gasket 446 is a layer of material arranged along contact pad 436E. Gasket 446 may be, for example, felt metal, or a ceramic fiber gasket. In low temperature applications, gasket 446 can be an elastomeric material. Gasket 446 improves distribution of contact loads incident on contact pad 436E by conforming to surface irregularities on contact pad 436E and any adjacent surface.

Discussion of Possible Embodiments

The following are non-exclusive descriptions of possible embodiments of the present invention.

A ceramic component retention system includes a metallic component having a first coefficient of thermal expansion. The ceramic component retention system further includes a ceramic component having a second coefficient of thermal expansion. At least one spring element is arranged between the metallic component and the ceramic component. The at least one spring element is configured to mechanically couple the ceramic component to the metallic component.

The ceramic component retention system of the preceding paragraph can optionally include, additionally and/or alternatively, any one or more of the following features, configurations and/or additional components:

The ceramic component may be a ceramic tile.

The ceramic component may be a blade, and the metallic component may be a disk.

A spring element includes a metallic substrate, an arch spring mechanically coupled to the metallic substrate, and a contact region arranged on the arch spring, configured to interact with a ceramic portion of a ceramic/metal assembly.

The arch spring may have a first free end contacting the metallic substrate.

The arch spring may have an opposite end connected to the metallic substrate, and the first free end of the arch spring may be configured to translate along the metallic substrate when the contact region is compressed toward the metallic substrate.

A deflection limiter may be arranged on the metallic substrate to prevent the first free end from traveling beyond a deformation limit.

The spring element may also include a deflection limiter arranged on the metallic substrate between the first free end and the opposite end.

The arch spring may further include a distension.

The spring element may also include a gasket arranged on the contact region.

The spring element may be between a metallic component having a first coefficient of thermal expansion and a ceramic component having a second coefficient of thermal expansion, and may mechanically couple the ceramic component to the metallic component.

A spring element includes a substrate extending along a first plane, a retention feature mechanically connected to the substrate, a conical element mechanically coupled to the retention feature and extending from the substrate in a direction perpendicular to the first plane, and a contact pad mechanically coupled to the conical spring and extending along a second plane.

The conical element may also define a plurality of slots.

The conical element may also include scallop features.

The retention feature may extend in the direction perpendicular to the first plane, such that deflection of the conical element is limited to an elastic deformation range.

The substrate may also define at least one cooling air passage.

The second plane may be parallel to the first plane.

The spring element may also include a ball and socket joint coupling the contact pad to the conical element.

The spring element may also include a gasket arranged on the contact pad.

The spring element may be between a metallic component having a first coefficient of thermal expansion and a ceramic component having a second coefficient of thermal expansion, and may mechanically couple the ceramic component to the metallic component.

Although the present invention has been described with reference to preferred embodiments, workers skilled in the art will recognize that changes may be made in form and detail without departing from the spirit and scope of the invention.

The invention claimed is:

1. A ceramic component retention system comprising:

a ceramic component having a first coefficient of thermal expansion; and at least one spring element including:

a metallic substrate;

an arch spring mechanically coupled to the metallic substrate;

a contact region arranged on the arch spring, the contact region in direct contact with the ceramic component and configured to interact with the ceramic component; and a deflection limiter located between the metallic substrate and the contact region, the deflection limiter configured to prevent deflection of the arch spring beyond a point that the arch spring will inelastically deform; and wherein the metallic substrate has a second coefficient of thermal expansion.

2. The ceramic component retention system of claim 1, wherein the metallic substrate is a metallic disk configured for holding a ceramic matrix composite blade.

3. The ceramic component retention system of claim 1, wherein the metallic substrate is a beam for mounting a CMC tile.

4. The ceramic component retention system of claim 1, wherein the metallic substrate is a metal duct.

5. The ceramic component retention system of claim 1, wherein the arch spring includes a distension.

6. The ceramic component retention system of claim 1, wherein the contact region spreads compressive force to an adjacent component.

7. The ceramic component retention system of claim 1, wherein the contact region is a contact pad.

* * * * *